US006626229B2

(12) United States Patent
Urlau et al.

(10) Patent No.: US 6,626,229 B2
(45) Date of Patent: Sep. 30, 2003

(54) METHOD AND DEVICE FOR PRODUCING SLABS

(75) Inventors: Ulrich Urlau, Moers (DE); Hans Jürgen Schemeit, Langenfeld (DE); Gerhard Böcher, Salzgitter (DE); Peter Müller, Salzgitter (DE)

(73) Assignee: Mannesmann AG, Düsseldorf (DE)

( * ) Notice: Subject to any disclaimer, the term of this patent is extended or adjusted under 35 U.S.C. 154(b) by 0 days.

(21) Appl. No.: 09/445,262

(22) PCT Filed: Jun. 3, 1998

(86) PCT No.: PCT/DE98/01544

§ 371 (c)(1),
(2), (4) Date: Dec. 2, 1999

(87) PCT Pub. No.: WO98/55250

PCT Pub. Date: Dec. 10, 1998

(65) Prior Publication Data

US 2003/0150588 A1 Aug. 14, 2003

(30) Foreign Application Priority Data

Jun. 3, 1997 (DE) ..... 197 24 232

(51) Int. Cl.[7] ..... B22D 11/10

(52) U.S. Cl. ..... 164/488; 164/437; 222/591

(58) Field of Search ..... 164/484, 488, 164/437, 459; 222/591, 594

(56) References Cited

U.S. PATENT DOCUMENTS

| | | | | | |
|---|---|---|---|---|---|
| 3,935,895 | A | * | 2/1976 | Fastner et al. | 164/56 |
| 5,205,343 | A | * | 4/1993 | Streubel et al. | 164/437 |
| 5,402,993 | A | * | 4/1995 | Hofmann et al. | 266/236 |
| 5,681,498 | A | * | 10/1997 | Poloni et al. | 222/594 |
| 5,716,538 | A | * | 2/1998 | Poloni et al. | 222/606 |
| 5,785,880 | A | * | 7/1998 | Heaslip et al. | 222/594 |
| 5,913,357 | A | * | 6/1999 | Hanazaki et al. | 164/453 |
| 6,152,336 | A | * | 11/2000 | Arvedi et al. | 222/594 |

* cited by examiner

*Primary Examiner*—M. Alexandra Elve
*Assistant Examiner*—Len Tran
(74) *Attorney, Agent, or Firm*—Cohen, Pontani, Lieberman & Pavane

(57) ABSTRACT

A process for producing slabs having a thickness D>100 mm, at casting speeds v<3 m/min, in a continuous casting installation in which melt is supplied to a permanent mold from a storage reservoir via an immersion nozzle and from which, on the aperture side, a strand shell enclosing a liquid crater is withdrawn into a strand guidance frame, in particular a bow-type continuous casting installation. The melt supplied enters the permanent mold at a speed ($v_K$) whose relationship with respect to the strand withdrawal speed ($v_B$) is:

$v_K:v_B$=6:1 to 60:1, and the flow filaments of the melt supplied are guided in such a way that, with regard to the melt level, they penetrate into the liquid crater over a length L<2 m over a wide front and with a profile which is rectangular in cross section.

6 Claims, 2 Drawing Sheets

METHOD AND DEVICE FOR PRODUCING SLABS

This is a U.S. national stage of application No. PCT/DE98/01544, filed on Jun. 03, 1998. Priority is claimed on that application and on the following application:

Country: Germany, Application No.: 197 24 232.4, Filed: Jun. 03, 1997.

BACKGROUND OF THE INVENTION

1. Field of the Invention

The invention relates to a process for producing slabs having a thickness D>100 mm, at casting speeds v<3 m/min, in a continuous casting installation in which melt is supplied to a permanent mold from a storage reservoir via an immersion nozzle and from which, on the aperture side, the strand shell enclosing a liquid crater is withdrawn into a strand guidance frame More particularly, the invention relates to; a bow-type continuous casting installation, and to a suitable appliance for out the process.

2. Discussion of the Prior Art

Steel Research 66 (1995) No. 7, pp. 287 to 293 "Flow dynamics in thin slab caster molds" has discloses a test layout in which an immersion nozzle which is attached to a tundish projects into a permanent mold. The permanent mold used here, with a thickness of approximately 80 mm, is the typical size for an installation for producing thin slabs and, during use of an immersion nozzle (FIG. 10 of the Steel Research reference) which has an open aperture, exhibits a central jet which projects deep into the liquid crater of the slab.

In a further configuration (FIG. 4 of the Steel Research reference), a baffle element, which diverts the liquid melt toward two openings on the narrow sides of the immersion nozzle, is provided at the aperture of the immersion nozzle. FIG. 5 of the reference shows that two partial streams are produced, which together with high energy of each individual flow filament, lead to turbulence in the melt.

German reference DE 43 20 723 has discloses a submerged nozzle, in particular for casting thin slabs, which has a lower section comprising side walls which are guided parallel to one another. Before entry to the lower section, a transverse web is provided, which diverts the melt flow in the direction of the widening of the lower flow shaft. The narrow sides of this immersion nozzle, which is provided in particular for thin slab installations, are guided parallel to one another.

The immersion nozzles which are known from the publications mentioned above produce a casting jet which, at a relatively high speed, penetrates into the liquid crater to corresponding depths.

SUMMARY OF THE INVENTION

In view of the above-mentioned prior art, the object of the present invention is to provide a process and a corresponding appliance for producing slabs, in which concentrations of impurities are avoided and in particular acid-gas-resistant steel goods can be cast even in bow-type continuous casting installations.

According to the invention, the liquid melt which is supplied to the permanent mold enters the liquid crater of the slab over a wide front and at speeds which are higher than the strand withdrawal speed. With regard to the cross section, the melt supplied has a rectangular profile and even at a depth of no more than 2 m in the liquid crater has already reached the same speed as the slab.

The speed $v_K$ of the melt supplied, which enters the permanent mold; has the following relationship with respect to the strand withdrawal speed $v_B$:

$v_K:v_B$=6:1 to 60:1.

In an advantageous embodiment of the invention, the liquid melt supplied is guided into the liquid crater with an entry profile which is formed as a rectangle, the clear width d of the rectangle having the following relationship with respect to the narrow side of the permanent mold D:

d:D=1:3 to 1:40 and the breadth b of the rectangle has the following relationship with respect to the wide side of the permanent mold B:

b:B=1:7 to 1:1.2.

The flow filaments leaving the immersion nozzle flow into the liquid crater at a width angle of $\alpha$=15 to 30° with respect to the slab withdrawal direction. With regard to the side D of the permanent mold narrow side, the liquid melt supplied impinges on the liquid crater over a depth T=0.1 to 1.5×D. The immersion nozzle used for this purpose has narrow side walls which, with regard to the center axis, open out conically at an angle $\alpha$ of 15 to 30°. The free cross section a of the aperture of the casting section of the immersion nozzle has the following relationship with respect to the internal cross section A of the permanent mold:

a:A=1:30 to 1:300.

In this case, the clear width d of the casting section of the immersion nozzle has the following relationship with respect to the narrow side D of the permanent mold:

d:D=1:2 to 1:40.

The profile produced in the permanent mold by means of the proposed process moreover has a positive effect on the movement of the melt in the region of the melt level in the permanent mold and on its behavior with regard to the mold powder.

When casting according to the invention, it was surprisingly established that the known differences in concentration over the cross section of the slab did not occur and that the degree of purity, based on nonmetallic inclusions, was significantly improved.

The proposed process makes it possible to produce slabs for steel goods where there are high demands both with regard to the nonmetallic degree of purity and also with regard to the freedom from segregation, as required, for example, for acid-gas-resistant steel goods.

Furthermore, when casting according to the invention, the reduced speed at which the steel flows into the liquid crater situated in the strand shell reduces the total solidification time. As a result, it is possible, on the one hand, to increase the specific casting capacity of the installations, or, on the other hand, to reduce the specific secondary cooling with a view to improved surface quality.

BRIEF DESCRIPTION OF THE DRAWINGS

An example of the invention is portrayed in the appended drawing, in which.

DETAILED DESCRIPTION OF THE PREFERRED EMBODIMENT

Figure 1:
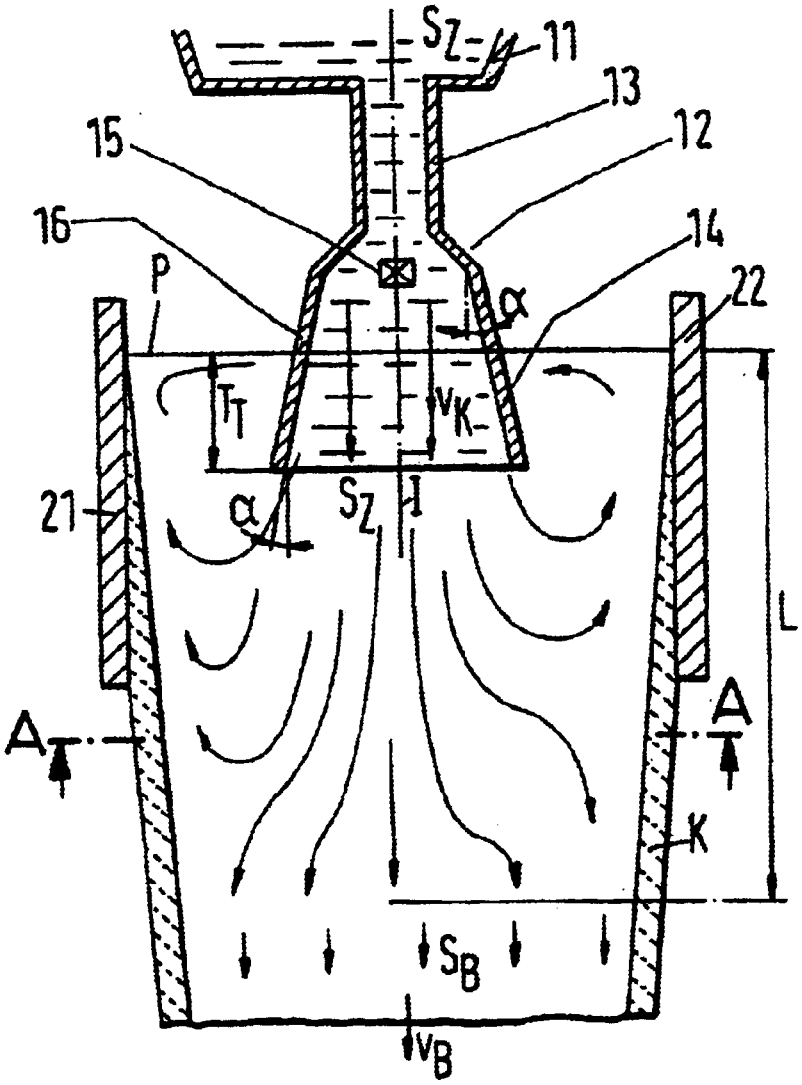
FIG. 1 shows the immersion nozzle/permanent mold region of a continuous casting appliance.

FIG. 1 shows a storage reservoir 11 to which an immersion nozzle 12 is attached. The immersion nozzle 12 has a tubular section 13 and, on the aperture side, a spade-shaped section 14 having the narrow sides 16 and the wide sides 17. A restrictor 15 is provided in the transition region between the two sections 13, 14 of the immersion nozzle 12.

On the aperture side, the spade-shaped section 14 extends into a permanent mold 21, which is filled with melt S and has narrow sides 22 and wide sides 23, to a depth $T_T$.

In FIG. 1, the flow filaments of the melt S are illustrated with the melt $S_Z$ supplied and the liquid crater $S_B$. It can be seen that the flow filaments, with regard to the wide sides, penetrate to a depth L into the melt S, which is surrounded by a strand shell K. The melt filaments are supplied at a speed $v_K$. In the region of the narrow sides 16 of the immersion nozzle 12, the melt filaments are at an angle $\alpha$ to the center axis I and move relatively early toward the narrow sides 22 of the permanent mold 21 and, in the region surface level P of the melt, seek to move toward the center of the permanent mold 21.

Figure 1A:
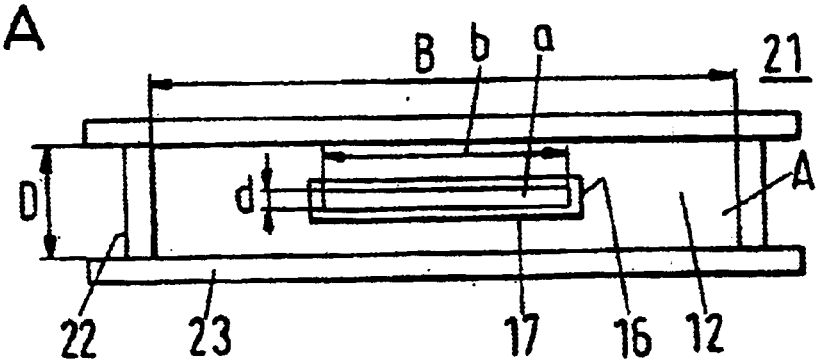
FIG. 1A is a section along line A—A in FIG. 1.

FIG. 1A shows the view AA, illustrating the permanent mold 21, which has the narrow sides 22 and the wide sides 23 which form a rectangle of the breadth B and the thickness D and the surface area A.

The immersion nozzle 12, with the wide sides 17 and the narrow sides 16 which form a rectangle of the breadth b and the thickness d and the surface area a, is arranged centrally in the cavity of the permanent mold 21.

Figure 2:
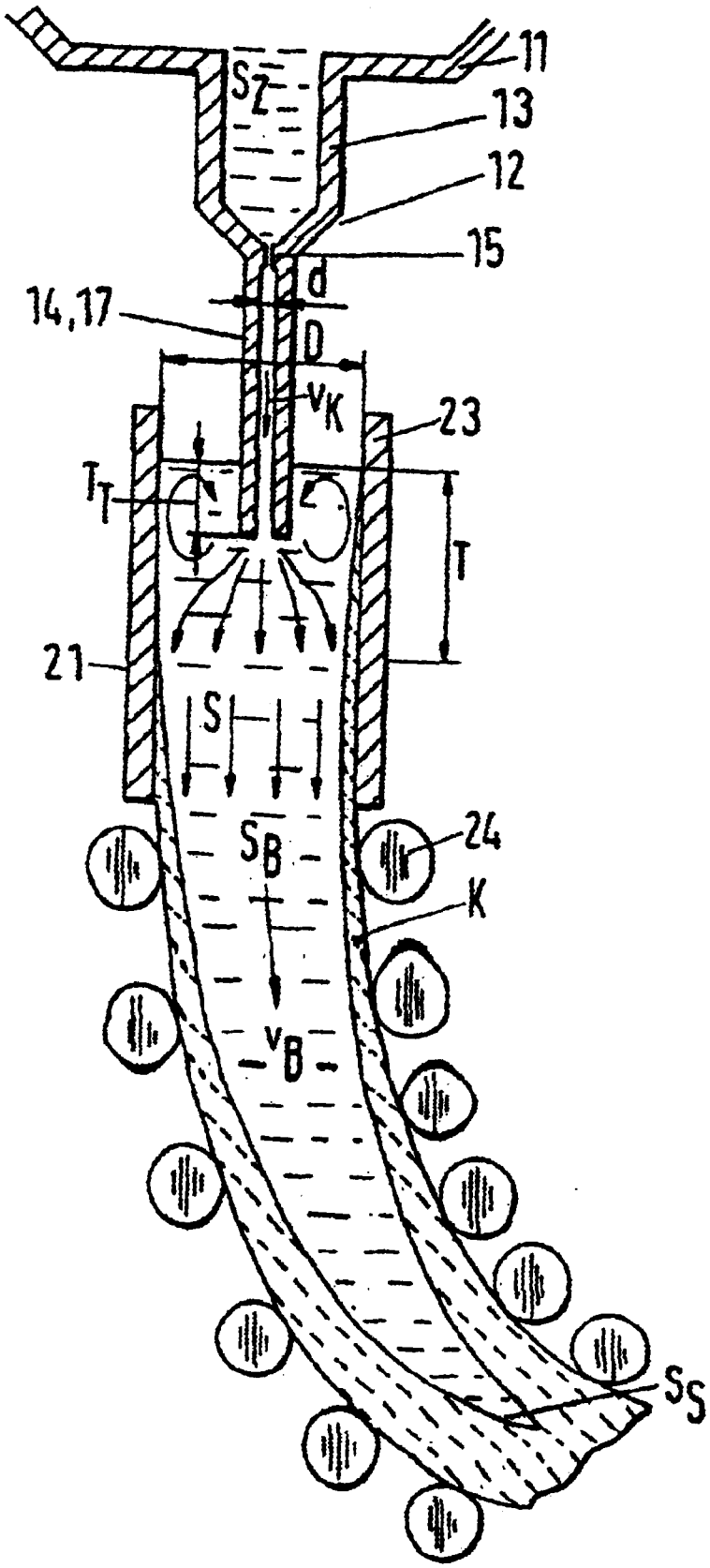
FIG. 2 shows a side view of a bow-type continuous casting installation.

FIG. 2 diagrammatically depicts a section through the continuous casting installation, in this case a bow-type continuous casting installation, having the storage reservoir 11 and the immersion nozzle 12 with the tubular section 13 and the spade-shaped section 14, here the wide sides 17. A restrictor 15 is arranged in the transition region between the sections 13, 14 of the immersion nozzle.

The aperture of the section 14 of the immersion nozzle projects into the melt S, which is situated in the permanent mold 21, to a depth $T_T$.

The wide side walls 23 of the permanent mold 21 are illustrated; their aperture-side end has formed a strand shell K of the slab, which shell surrounds the melt S down to the depth of the liquid crater tip $S_s$.

The strand guidance rollers 24 are arranged downstream of the permanent mold 21.

The melt $S_s$ supplied penetrates into the liquid crater $S_B$, which is situated in the permanent mold 21, at a speed $v_K$, specifically to a depth T with respect to the wide sides 23. The liquid crater is then at a speed $v_B$, which corresponds to the withdrawal speed of the slab and thus also of the strand shell K.

What is claimed is:

1. A process for producing slabs having a thickness D>100 mm, at casting speeds v<3 m/min, in a continuous casting installation, comprising the steps of:

supplying melt to a permanent mold in a flow direction from a storage reservoir via an immersion nozzle having a restrictor element at a distance upstream from an outlet end of the nozzle;

withdrawing a strand shell enclosing a liquid crater from an aperture side of the permanent mold into a strand guidance frame in a slab withdrawal direction, the melt supplied entering the permanent mold at a speed ($v_K$) whose relationship with respect to strand withdrawal speed ($v_B$) is:

$v_K$: $v_B$=6:1 to 60:1; and guiding the melt supplied so that, with regard to melt level, flow filaments of the melt flowing out of the immersion nozzle penetrate into the liquid crater over a length L<2 m in the slab withdrawal direction over a wide front and with a profile which is rectangular in cross section.

2. A process as defined in claim 1, wherein the liquid melt supplied flows into the liquid crater with an entry profile which is formed as a rectangle, the rectangle having a clear width (d) with the following relationship with respect to a narrow side of the permanent mold (D):

d:D=1:3 to 1:40 and a breadth (b) of the rectangle having the following relationship with respect to a wide side of the permanent mold (B):

b:B=1:7 to 1:1.2.

3. A process as defined in claim 1, wherein the guiding step includes guiding the melt facing toward narrow slides of the permanent mold to flow into the liquid crater at an angle ($\alpha$) of $\alpha$=15 to 30° with respect to the slab withdrawal direction.

4. A process as defined in claim 1, wherein the supplying step includes supplying the liquid melt via the immersion nozzle so that the liquid melt impinges on the liquid crater over a depth (T), where T=0.1 to 1.5×D.

5. A continuous casting appliance for producing slabs, comprising:

a storage reservoir for holding liquid melt;

a permanent mold with a thickness (D), where D>100 mm; and an immersion nozzle arranged to guide the liquid melt from the reservoir to the permanent mold in a flow direction, the nozzle having at least one casting section with an elongate cross section including a restrictor element upstream from an outlet end of the nozzle which reduces speed and flow shape of a main flow of melt entering the casting section from the reservoir, the casting section being configured so as to have narrow side walls that are at an angle $\alpha$=15 to 30° with respect to a center axis, which angle opens out in the direction of flow, wherein the casting section of the immersion nozzle has an aperture with a free cross section (a) which has a relationship with respect to an internal cross section (A) of the permanent mold:

a:A=1:30 to 1:300.

6. A continuous casting appliance as defined in claim 5, wherein, the casting section of the immersion nozzle having a clear width (d) having a relationship with respect to a narrow side (D) of the permanent mold:

d:D=1:2 to 1:40.

* * * * *